United States Patent [19]

Riley et al.

[11] Patent Number: 4,712,349

[45] Date of Patent: Dec. 15, 1987

[54] PROTECTED MEMBRANE ROOF SYSTEM FOR HIGH TRAFFIC ROOF AREAS

[75] Inventors: Elizabeth Riley, Newark; Wayne E. Petersen, Granville, both of Ohio

[73] Assignee: The Dow Chemical Company, Midland, Mich.

[21] Appl. No.: 11,664

[22] Filed: Feb. 5, 1987

Related U.S. Application Data

[63] Continuation-in-part of Ser. No. 686,069, Dec. 24, 1984, Pat. No. 4,658,554.

[51] Int. Cl.[4] ..... E04B 5/00

[52] U.S. Cl. ..... 52/408; 52/199; 52/309.12

[58] Field of Search ..... 52/408, 410, 199, 309.5, 52/309.12; 156/324.4

[56] References Cited

U.S. PATENT DOCUMENTS

| | | | |
|---|---|---|---|
| 3,318,744 | 5/1967 | Hurley | 156/322 |
| 3,411,256 | 11/1968 | Best | 52/408 |
| 3,763,614 | 10/1973 | Hyde et al. | 52/408 X |
| 3,892,899 | 7/1975 | Klein | 52/408 X |
| 4,370,374 | 1/1983 | Raabe et al. | 156/324.4 |
| 4,464,215 | 8/1984 | Cogliano | 52/169.14 |
| 4,492,064 | 1/1985 | Bynoe | 52/309.8 |

FOREIGN PATENT DOCUMENTS

| | | | |
|---|---|---|---|
| 1816577 | 6/1970 | Fed. Rep. of Germany | 52/199 |
| 2327840 | 12/1974 | Fed. Rep. of Germany | 52/408 |
| 2734195 | 2/1979 | Fed. Rep. of Germany | 52/199 |
| 2742444 | 3/1979 | Fed. Rep. of Germany | 52/408 |
| 135639 | 5/1979 | German Democratic Rep. | 52/408 |
| 775258 | 10/1980 | U.S.S.R. | 52/199 |

*Primary Examiner*—Carl D. Friedman

[57] ABSTRACT

An insulated roofing system is provided in which a waterproof membrane is applied to the roof deck. Extruded panels of closed cell polystyrene foam are provided on top of the membrane, thus protecting the membrane from thermal cycling, ultraviolet rays, and physical damage. The foam panels provide excellent insulation and are resistant to water. A waterproof plastic film is bonded to the undersurface of each panel positively to exclude water. The foam panels are cut mechanically or are grooved to provide on the upper surface integral ribs spaced by channels. Concrete panels are laid directly on top of the polystyrene foam and rest gravitationally on the ribs. The ribs provide for ventilation and moisture removal on hot, dry days. Removal of water vapor is enhanced by the increased area exposed to the ambient environment and derived from the cratered surfaces generated by cutting sections out of the foamed plastic panels. The composition, texture, and the physical contour or configuration of the cut surfaces bounding the cut grooves or channels formed in the foam plastic panels enhance the dissipation and dispersion of moisture, as compared with surfaces covered with a dense skin such as is produced upon generating the channels in an extrusion process.

7 Claims, 3 Drawing Figures

PROTECTED MEMBRANE ROOF SYSTEM FOR HIGH TRAFFIC ROOF AREAS

The present application is a Continuation-in-Part of applicants' prior application Ser. No. 686,069 filed Dec. 24, 1984, now U.S. Pat. No. 4,658,554, and the entire disclosure of that application is hereby incorporated herein by reference, to the extent not inconsistent herewith.

BACKGROUND OF THE INVENTION

For many years it was the universal practice to construct roofs with a waterproof layer or membrane on the outer surface thereof. Such roofing is still used in many installations, but has numerous disadvantages. The waterproof membrane, which may be bituminous built-up sheet or which may be a single sheet of waterproof material, is exposed to extreme temperature variations, as much as 210 degrees F., to ultraviolet radiation, and to physical abrasion, all of which have a deleterious effect on the life of the roofing.

It is an established common practice to provide insulation in roof construction, and when insulation is located below the waterproof membrane, in the roofing system outlined above, it is often necessary to provide a second waterproof membrane beneath the insulation to prevent moisture from within the building from condensing in the insulation and substantially vitiating or essentially destroying its insulating attributes.

An alternative upside-down roofing construction is known in which the insulation is applied over the waterproof membrane, see for example U.S. Pat. Nos. 3,411,256 and 3,763,614. In this alternative roof construction the waterproof membrane, which may be a built-up membrane or a single waterproof layer such as of elastomeric, plastomeric, liquid applied or modified bitumen, is applied directly to the surface of the roof. Blocks of foam plastic insulation are then placed to overlie the waterproof membrane. Polystyrene plastic resin foam is a superior product for such use, and STYROFOAM brand plastic foam made by Dow Chemical Company is a preferred example. It is a tough, closed cell rigid plastic foam having excellent moisture resistance and high compressive strength.

The polystyrene foam insulation placed over the waterproofing membrane rather than under the membrane protects the membrane from the effects of thermal cycling, temperature extremes, and physical abuse, thus reducing maintenance costs and prolonging the useful life of the entire roofing system. It has been found that the membrane so protected remains at stable temperatures below 100 degrees F. even in hot summer weather. In fact, under normal conditions, the temperature of the membrane will remain within 15–20 degrees F. of the building's inside temperature.

Typically, a polymeric fabric is installed over the foam to stabilize the system, and crushed stone or gravel ballast is applied to counteract the buoyancy of the insulation boards, to provide flammability resistance to the roof surface, and to shield the foam and fabric from ultraviolet radiation. As an alternative, paving blocks may be used in place of stone, particularly if traffic is to be expected on the roof.

When traffic is expected, as in the construction of a plaza deck, pedestals or stone are provided to space the paving blocks above the top of the foam insulation to permit adequate air circulation for drying of the roofing system on warm, dry days. It will be appreciated that a base roof or deck of substantial strength must be provided to support the weight of such a roofing system.

OBJECTS AND SUMMARY OF THE PRESENT INVENTION

It is an object of the present invention to provide a roofing system in which a waterproof membrane is applied directly to the surface of a roof, suitable panels of rigid foam insulation having a plastic film laminated to the lower surface are applied over the membrane, and concrete paving blocks are applied directly to the foam insulation without the necessity of pedestals or stone.

It is a feature of the roofing system of the present invention that there are provided insulation panels of closed foam plastic and having elongated ribs arrayed on an upper surface of the panels and coextensive with cut-out channels interposed between and demarking the ribs.

More particularly, it is an object of the present invention to provide such a roofing system in which the upper surfaces of the foam plastic insulating blocks are ribbed, having alternating ribs and valleys, with the concrete paving blocks laid directly on the ribbed surfaces of the foam blocks.

It is a feature of the present invention that the roof system includes foam plastic panels which, subsequent to forming, are cut longitudinally to provide grooves or channels having bounding walls in which exposed crater-like recesses resulting from a cutting through of pockets in the foam panel are exposed, thus significantly increasing the panel surface area exposed and accelerating evaporation of moisture from the channel-delineating walls.

Foam plastic panels of the type finding utility in the roof system of the present invention may be produced using any preferred technique, including by casting or by extrusion. The panels are then physically modified by cutting grooves longitudinally across an upper surface zone of the panels to form alternating channels and ribs, the latter defining a discontinuous planar top surface of the panels.

Extruded panels of polystyrene foam insulation are known which have one surface with integrally formed, alternating ribs and grooves of equal width. In such extruded panels it was found (Peterson and Riley U.S. application Ser. No. 686,069, filed Dec. 24, 1984) that the polystyrene foam plastic material in the ribs is stiffer, stronger, and more resistant to deformation than the foam plastic material in the valleys, and throughout the body of the panels. It was believed that this strength increase was due to molecular orientation of the material brought about as it foamed during extrusion.

In accordance with the present invention it has been found that in panels in which alternate ribs and grooves are produced by excising lineal sections from plastic panels, the panels still exhibit enhanced physical strength in the rib zones.

In a preferred embodiment of the invention the rib array configuration in the foam plastic insulation panels is formed by cutting grooves or channels in extruded plastic sheet material, that is, by excising lineal sections from the panels, after extrusion.

An important feature of the insulation panels of the present invention is that in cutting the channels in the panels, an outer, essentially smooth, high-density skin is removed to present a surface which has been found to be much more conducive to releasing and dispersing of moisture accummulating on the outer upper surface of the panel.

Yet another feature of the foam plastic insulation panel components of the roofing system of the present invention is that the undersurface of each panel has an intact high density outer skin produced during extrusion and operative to deter invasive entry of water and moisture vapor into the panels, the lower surface of each panel also being bonded to a co-continuous water-impervious film or sheet further to obviate intrusion of moisture into the body of the panel.

A related feature of the invention is that in cutting the plastic panels to form the channel and ribs array, hollow cells present within the body of the foam plastic panel are sliced through to establish channel-bounding walls having crater-like recesses in the exposed surface thereof, the walls presenting outwardly directed faces in which the area of exposed plastic material to the ambient environment and embraced in the recess-marked surface is significantly increased as compared with planar areas delineated by the perimetric borders of the channel-bounding walls.

A practical advantage derived from the increase in exposed surface area of the plastic panels, and realized by excising lineal sections from the panels to form channels therein, is that the resulting increase in surface area exposed to the ambient environment effects a corresponding increase in the effective rate of evaporation of moisture from the panels at the exposed walls of the channels formed in the panels.

Yet another important advantage realized by producing the channels by a cutting process rather than by generating the channels during an extrusion process is that the smooth, high-density and essentially impermeable outer film produced during extrusion is removed to expose a cratered surface which is much more effective in the dispersion of water and moisture vapor from the plastic panel to a surrounding ambient system.

In accordance with the present invention the ribbed and grooved foam plastic insulation material, having a plastic film laminated to the lower surface, is placed on top of a waterproof membrane, and concrete paving blocks are then laid directly on the ribs of the plastic panels and are held gravitationally thereon.

THE DRAWINGS

The invention will best be understood from the following specification taken in connection with the accompanying drawings wherein.

DETAILED DESCRIPTION OF THE ILLUSTRATED EMBODIMENT

Figure 1:
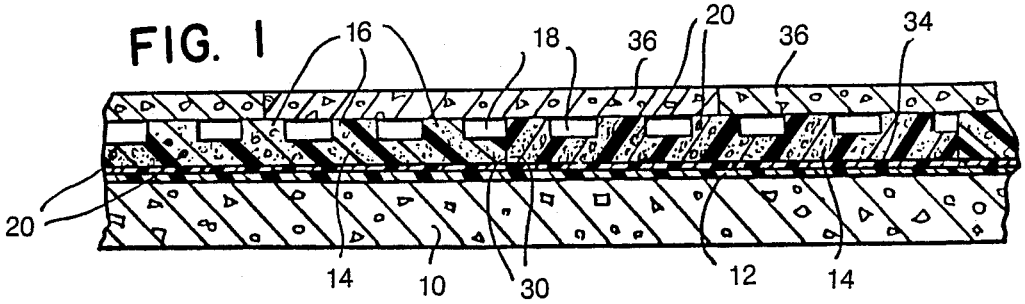
FIG. 1 is a fragmentary cross-sectional view through a roofing system constructed in accordance with the principles of the present invention.
Figure 2:
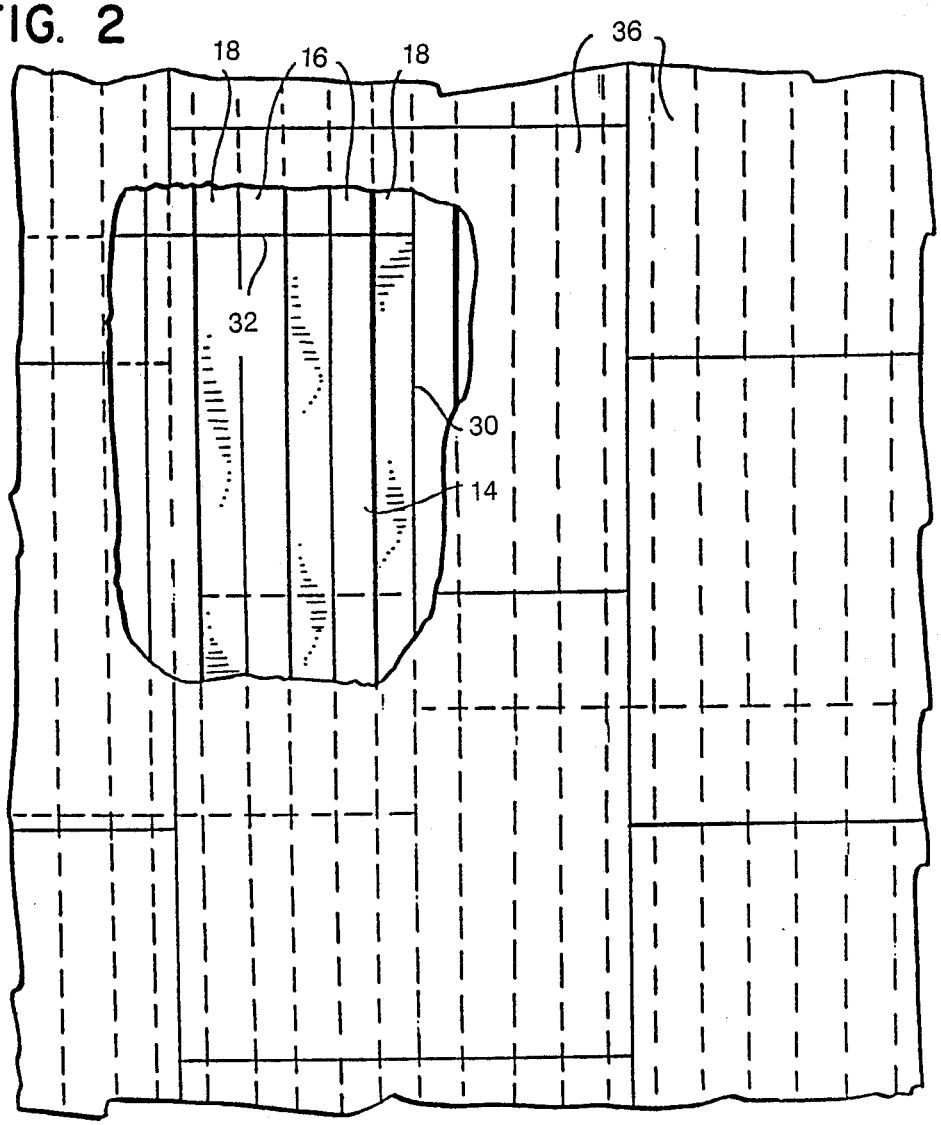
FIG. 2 is a top view thereof with a portion broken away.

A base roof or deck 10 is shown in FIG. 1 as comprising a concrete slab. This slab would preferably be reinforced. The roof deck could equally well be of wood construction, or of metal construction, and concrete simply has been chosen by way of illustration. A waterproof membrane 12 overlies the roof deck 10. The membrane can be attached to the roof deck, or it can be loose. The membrane can be a single sheet of polymeric material, liquid applied, modified bituminous sheet, or it can be an asphaltic built-up membrane.

Panels 14, preferably of extruded polystyrene foam, are laid on top of the membrane 12. The foam panels include, on the top surface only, integral ribs 16 interspaced by grooves or valleys 18. The ribs and the grooves in the illustrated embodiment are of equal lateral extent, being approximately one inch wide, and about ⅛ to ½ inch deep.

In accordance with the present invention the upper surface zonal configuration of alternating ribs and grooves is produced by physically removing elongated sections of plastics material from the preformed, extruded panels. Suitable cutters may be used for this purpose. An important advantage achieved by producing the channels (and ribs) by cutting the plastic panels 14 rather than by extrusion techniques is that in the cutting method of the present invention the operation has the effect of exposing crater-like recesses 20 as elements of the cut surfaces 22 bounding the grooves or channels 18. The recesses 20 greatly increase the surface area exposed to the ambient environment and thus increase the rate of moisture dissipation from the panels, by evaporation at the walls 22 bounding the channels 18. Additionally, the cutting removes the smooth, high-density outer film formed upon extrusion and exposes a surface much more favorable to the dissipation of water and moisture.

It has been found that the foam material at the rib sections 16 is stronger, more rigid, and more deformation resistant than is the material 24 beneath the grooves or valleys 18. The polystyrene foam panels 14 are butted together along the longitudinal side edges 30 thereof. The ends 32 of the panels also are butted together. The thickness dimension selected for the foam panels 14 is governed by the degree of insulating quality desired, but typically would be on the order of one to six inches thick. The extruded polystyrene foam is of the closed cell variety to prevent moisture penetration. The foam panels 14 by way of illustration are two feet by four feet, but the dimensions are not critical. The lengths could be nine feet, or as much as sixteen feet, while the width could be as little as sixteen inches, to perhaps as much as four feet. Product size is not a critical factor, but handleability is. In windy areas the panels must not be so large as to be blown from a roof before the paving blocks are applied to hold then down.

A plastic film lamination 34 is secured to the lower surface of each foam insulation panel 14. The film 34 may be adhesively secured to the foam, or may be heat bonded thereto. In one preferred example of the invention the film 34 comprises LLDPE (linear low density polyethylene) (1.7 mils.) plus EVA (ethylene-vinyl acetate) (0.3 mil). Upon heating, the film is readily softened to fuse tenaciously to the foam. There may also be a certain degree of softening of the foam which enhances the adherence.

Concrete paving blocks 36 are laid directly on top of the foam panels 14. The paving blocks 36 conveniently are two feet square and two inches thick, and are not necessarily reinforced. Other dimensions can be used, such as eight inches by sixteen inches, and reinforcement of the concrete can be used if desired. The concrete blocks 36 are simply butted against one another, and preferably are laid so that the butted junctions do not coincide or register with the butted junctions of the underlying foam panels 14.

Figure 3:
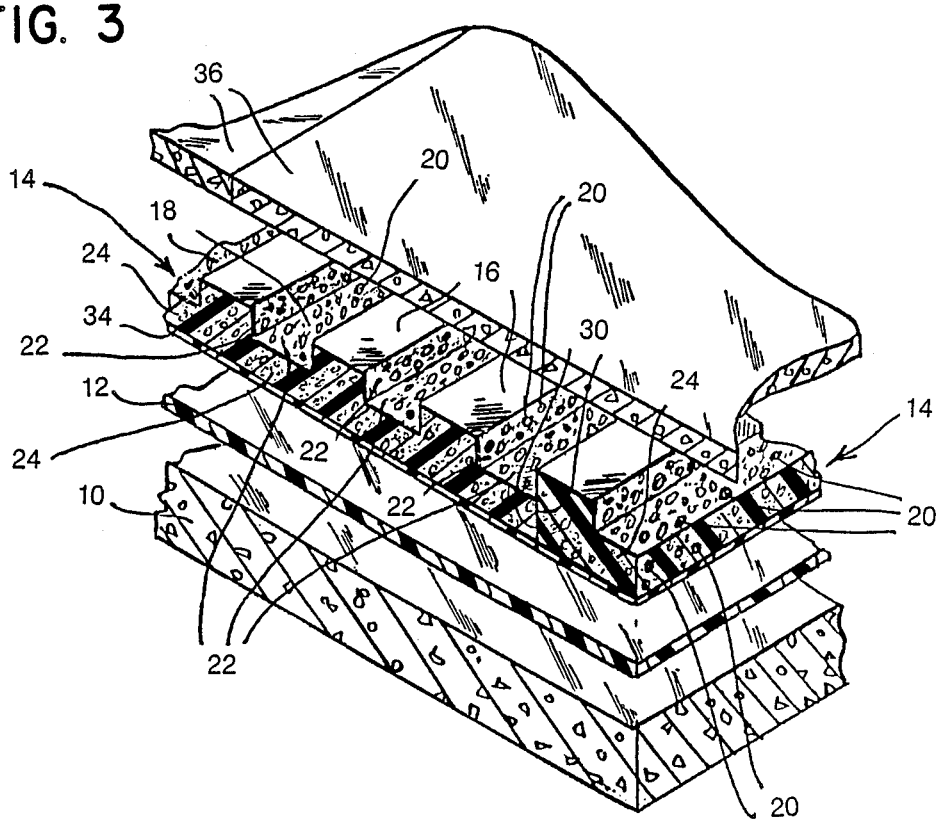
FIG. 3 is a fragmentary exploded perspective view showing the recesses in the surfaces of the channel-bounding walls and the relation of parts of the roofing system to one another.

The exploded, fragmentary perspective view of FIG. 3 is similar to FIG. 1 and emphasizes the adherence of the film 24 to the underside of the panel 14, and the non-securement of other parts to one another, and shows the crater-like surface at walls bounding the cut-out channels 18.

The polystyrene foam panels 14 are of the closed cell variety and are reasonably waterproof. However, constant presence of water will cause some water penetration and associated loss of insulating qualities. The film adhered or sealed to the bottom surface of the foam panels 14 inhibits water penetration of the foam. The alternating ribs 16 and recesses or valleys 18 in the upper surface of the foam permit air circulation so that any rainwater or other moisture on top of the panels is dissipated on hot, dry days. The increased surface provided by the crater-like formations 20 in the cut channel surfaces 22 enhances the rate of water evaporation, as does the physical form of the exposed surfaces 22. As will be appreciated, sun shining on the concrete paving blocks will heat the air in the recesses and between the ribbed surfaces and the concrete paving blocks, thereby materially increasing the pressure of such air, thus augmenting the convection forces causing air to exit through the butted joints of the concrete paving blocks.

Moisture penetration of the foam panel, and resulting loss of insulating qualities, therefore, is substantially reduced by the present invention. The accumulation of water over time is also minimized. A film of water such as might lie between a flat topped foam insulation panel and a paver laid directly thereon would act as a vapor barrier to prevent drying out of the foam. With the present construction any film that might lie between the tops of the ribs and the concrete paving blocks is of minimal importance, since the sides 22 of the ribs 16 and the floors of the grooves or valleys 18 provide a large area free of such film for drying of the foam. The exposed craters 20 further increase the area exposed, and otherwise augment the rate of moisture dispersion as compared with a skinned-over surface. Furthermore, some heating of the paving blocks dissipates the water film as water vapor into the grooves or valleys between the ribs, from whence it circulates out through the butt joints between the paving blocks. The ribbed construction also facilitates drying of the undersurfaces of the paving blocks. Constant wetness of the undersurfaces of the paving blocks causes the bottom surfaces thereof to spall off in a few years.

In conventional plaza construction using upside-down roof construction, pedestals are used for supporting the weight of the concrete paving blocks. Pedestals occupy space that could otherwise be used for insulation, and hence do not add to the overall insulating qualities. In addition, the pedestals are expensive, both in material cost and in labor of installation. In accordance with the present invention the costs of pedestals and the non-insulating area thereof are eliminated. The present construction is not intended as a full substitute for plaza construction, but it can support rather considerable weight, and is fully suitable for foot traffic or for small vehicles for maintenance. STYROFOAM insulation, for example, has a design compressive strength of about 25 pounds per square inch. If a safety factor of 5:1 is provided, then this reduces to 5 pounds per square inch. A 24 by 24 inch paving block has approximately 600 square inches, which covers a like area of the present plastic foam insulation, but divided by two due to the equal widths of the ribs and valleys. This provides 300 square inches of supporting area for a two foot by two foot paving block, which multiplied by the five pounds per square inch previously noted results in a total of 1500 pounds that can be applied to each paving block with a 5:1 safety factor against permanent deformation of the supporting STYROFOAM insulation due to creep and compressive fatigue. Probably an even greater total weight can be supported since, as previously noted, the foam plastic material in the ribs is stiffer, stronger, and more resistant to deformation than the foam plastic material in the valleys. Other foam plastic insulating materials have a compressive strength as low as 10 pounds per square inch, but with the 5:1 safety factor heretofore used as exemplary, each paving block can support 600 pounds with such foam plastic material.

Exemplary dimensions have heretofore been given for the rib width and spacing. However, these dimensions are not critical and can vary widely. The ribs might be as little as 1/16th inch high, and the supporting area could be less than 50%, i.e., the ribs could be narrower than the intervening valleys.

The present roofing system is highly desirable for construction of insulated roofs in which a certain amount of traffic or maintenance is anticipated. The present roof construction also is beneficial for use in roof construction below radio and TV antenna towers in cold climates. Icicles dropped from such towers readily penetrate gravel-topped roof constructions, initially damaging the membrane and/or underlying insulation and leaving them vulnerable to possible further deterioration from water and ice. The paving blocks used in the present construction are not penetrated by such icicles; no damage is caused by falling icicles.

A figure of 25 pounds per square foot compressive strength for polystyrene insulation has been given heretofore. This is a minimum figure, and the compressive strength typically will run on the order of 40 pounds per square inch. Such forces result in approximately 1/10th inch deformation, and dimensions return to normal upon removal of the compressive force if yield has not been reached.

The present roof system possesses the advantage of prior upside-down insulated roof construction. However, in addition thereto water absorption by the insulation is markedly reduced by the water-impervious film bonded to the lower surface of the insulation, and by the ribbed upper surface which allows drying of the insulation and the underside of the paving blocks on warm, dry days. The rate at which water vaporizes from the channels is enhanced by the added surface provided by the cutting out of sections from the plastic panels, and by the physical form presented by the mechanically cut surfaces defining the channels. When the waterproofing membrane applied to the top of the roof deck is a bituminous built-up laminated structure, the membrane is necessarily secured to the deck. However, in instances where a polymeric sheet is used, it can be applied loose over the surface of the deck, and the entire structure is held down by the weight of the concrete paving blocks.

The specific example of the invention as herein shown and described is for illustrative purposes only. Various changes in structure will no doubt occur to those skilled in the art, and will be understood as forming a part of the present invention insofar as such modifications fall within the spirit and scope of the appended claims.

What is claimed is:

1. A roofing system comprising a roof deck, a waterproof membrane above said roof deck, a plurality of panels of foam plastic insulation overlying said waterproof membrane, each of said foam plastic insulation panels having bounding perimetric edges and edge surfaces and having a planar lower surface and a plurality of flat-topped, parallel, raised, elongated ribs on an upper face thereof, and spaced apart by grooves, said ribs being integral with said panels and defining zonal sectors which are stiffer, stronger, and more resistant to deformation than a remainder of each panel, said grooves in said panels comprising channels including bounding sidewalls and base walls derived upon excision of laterally-spaced elongated, lineal sections from said panels transversely thereof, said bounding sidewalls and said base walls being formed with crater-like recesses in exposed surfaces thereof and opening outwardly of said walls, said ribs having tops forming a discontinuous planar surface substantially parallel to said lower surface, a waterproof plastic film having peripheral edges coincident with said bounding perimetric edges of a respective panel and being coextensive with and bonded to only the lower surface thereof, and resting on said waterproof membrane in an unsecured, face-to-face contacting relation, each of said panels being otherwise free of plastic film and exposed to ambient air for evaporation of moisture, said plurality of panels being in substantially abutting relation at edges thereof, and a plurality of concrete panels carried on said foam plastic insulation panels and resting on said rib top discontinuous planar surface.

2. A roofing system as set forth in claim 1 wherein said recesses constitute cell portions of said foam plastic panel and originating in interior zones thereof and being exposed upon excised removal of sections from said panels, said bounding sidewalls and said base walls with said recesses formed therein defining faces presented outwardly, each said face having a total surface area, including surface area embraced by said crater-like recesses, which is greater than an area delineated by perimetric borders of said walls bounding said channels, thereby to increase an effective rate of evaporation of moisture from said panel at said walls bounding said channels.

3. A roofing system as set forth in claim 2 wherein said film is heat bonded to said lower surface of each said panels.

4. A roofing system as set forth in claim 3 wherein said film is a composite film having a portion heat softened to fuse said film to said foam panels.

5. A roofing system as set forth in claim 4 wherein said film comprises low density polyethylene and ethylene-vinyl acetate.

6. In a roofing system including a roof deck, a waterproof membrane above said roof deck, a plurality of panels of foam plastic insulation overlying said waterproof membrane, each of said foam plastic insulation panels having bounding perimetric edges and edge surfaces and having a planar lower surface and a plurality of flat-top, parallel, raised, elongated ribs on an upper face thereof and spaced apart by grooves, said ribs being integral with said panels and defining zonal sectors which are stiffer, stronger, and more resistant to deformation than a remainder of each panel, said ribs having tops forming a discontinuous planar surface substantially parallel to said lower surface, a waterproof plastic film having peripheral edges coincident with said bounding perimetric edges of a respective panel and being coextensive with and bonded to only the lower surface thereof and resting on said waterproof membrane in an unsecured face-to-face contacting relation, each of said panels being otherwise free of plastic film and exposed to ambient air for evaporation of moisture, said plurality of panels being in substantially abutting relation at edges thereof, and a plurality of concrete panels carried on said foam plastic insulation and resting on said rib top discontinuous surface, the improvement wherein said grooves comprise channels derived upon excision of laterally-spaced, elongated, lineal sections from said plastic panels transversely thereof, said channels including bounding sidewalls and base walls, said bounding sidewalls and said base walls of said channels being formed with crater-like recesses in exposed surfaces thereof for increasing an effective total surface area embraced by walls bounding said channels, and for increasing an effective rate of evaporation of moisture from said panels at said channels.

7. In a roofing system including a roof deck, a waterproof membrane above said roof deck, a plurality of panels of foam plastic insulation overlying said waterproof membrane, each of said foam plastic insulation panels having bounding perimetric edges and edge surfaces and having a planar lower surface and a plurality of flat-top, parallel, raised, elongated ribs on an upper face thereof and spaced apart by grooves, said ribs being integral with said panels and defining zonal sectors which are stiffer, stronger, and more resistant to deformation than a remainder of each panel, said ribs having tops forming a discontinuous planar surface substantially parallel to said lower surface, a waterproof plastic film having peripheral edges coincident with said bounding perimetric edges of a respective panel and being coextensive with and bonded to only the lower surface thereof and resting on said waterproof membrane in an unsecured face-to-face contacting relation, each of said panels being otherwise free of plastic film and exposed to ambient air for evaporation of moisture, said plurality of panels being in substantially abutting relation at edges thereof, and a plurality of concrete panels carried on said foam plastic insulation and resting on said rib top discontinuous surface, a method for enhancing the rate of evaporation of water accumulated on said panels at upper zones thereof, said method comprising physically modifying a surface configuration of said panels and increasing the area of said panels exposed to ambient atmosphere, said method including the steps of physically cutting a plurality of laterally-spaced, elongated sections in said panels for removal therefrom, removing said cut sections from said panels to form said grooves and said ribs in said panels, exposing to ambient atmosphere cut surfaces of walls bounding said grooves, and simultaneously exposing to ambient atmosphere crater-like recesses in said walls formed as depressions in the exposed surfaces of said walls and derived from cutting through voids present in the foam plastic panels as originally formed.

* * * * *